US010144224B2

(12) United States Patent
Matsusaki et al.

(10) Patent No.: US 10,144,224 B2
(45) Date of Patent: Dec. 4, 2018

(54) THERMAL HEAD AND THERMAL PRINTER

(71) Applicant: KYOCERA Corporation, Kyoto-shi, Kyoto (JP)

(72) Inventors: Yuuki Matsusaki, Kirishima (JP); Masashi Yoneta, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/748,088

(22) PCT Filed: Jun. 23, 2016

(86) PCT No.: PCT/JP2016/068671
§ 371 (c)(1),
(2) Date: Jan. 26, 2018

(87) PCT Pub. No.: WO2017/018106
PCT Pub. Date: Feb. 2, 2014

(65) Prior Publication Data

US 2018/0207951 A1 Jul. 26, 2018

(30) Foreign Application Priority Data

Jul. 29, 2015 (JP) ..... 2015-149733

(51) Int. Cl.
*B41J 2/335* (2006.01)
*B41J 2/355* (2006.01)

(52) U.S. Cl.
CPC ..... *B41J 2/3353* (2013.01); *B41J 2/3351* (2013.01); *B41J 2/3355* (2013.01); *B41J 2/3359* (2013.01);
(Continued)

(58) Field of Classification Search
CPC ..... B41J 2/3353; B41J 2/33535; B41J 2/355; B41J 2/33515; B41J 2/3355; B41J 2/3351; B41J 2/3359
See application file for complete search history.

(56) References Cited

U.S. PATENT DOCUMENTS 8,466,942 B2 * 6/2013 Daicho ..... B41J 2/335 347/202
2012/0147118 A1 6/2012 Daicho

FOREIGN PATENT DOCUMENTS

JP 63-193853 A 8/1988
JP 01-128849 A 5/1989
(Continued)

OTHER PUBLICATIONS

Machine translation of JP 05-057933, published on Mar. 1993.*
(Continued)

*Primary Examiner* — Huan Tran
(74) *Attorney, Agent, or Firm* — Volpe and Koenig, P.C.

(57) ABSTRACT

A thermal head according to the disclosure includes: a substrate; a heat generating section disposed on the substrate; an electrode disposed on the substrate so as to be electrically connected to the heat generating section; a protective layer which covers the heat generating section and part of the electrode, the protective layer being formed of an inorganic material; a cover layer disposed on the protective layer, the cover layer being formed of a resin material; and inorganic particles disposed on a surface of the protective layer so as to protrude from the surface. Moreover, the inorganic particles each comprise a first portion located inside the cover layer and a second portion located inside the protective layer.

11 Claims, 10 Drawing Sheets

(52) U.S. Cl.
CPC ..... *B41J 2/33515* (2013.01); *B41J 2/33535* (2013.01); *B41J 2/355* (2013.01)

(56) References Cited

FOREIGN PATENT DOCUMENTS

| | | | |
|---|---|---|---|
| JP | 05-057933 | A | 3/1993 |
| JP | 2006-181822 | A | 7/2006 |
| JP | 2010-052257 | A | 3/2010 |
| JP | 2012-121283 | A | 6/2012 |
| JP | 2014-144623 | A | 8/2014 |

OTHER PUBLICATIONS

Written Opinion for PCT/JP2016/068071, dated Jan. 30, 2018.*
International Search Report, PCT/JP2016/068671, dated Aug. 30, 2016, 2 pgs.

* cited by examiner

THERMAL HEAD AND THERMAL PRINTER

TECHNICAL FIELD

The present invention relates to a thermal head and a thermal printer.

BACKGROUND ART

As printing devices for use in facsimiles video printers, and so on, various types of thermal heads have been proposed to date. For example, there is known a thermal head comprising: a substrate; a heat generating section disposed on the substrate; an electrode disposed on the substrate so as to be electrically connected to the heat generating section; and a protective layer which covers the heat generating section and part of the electrode. In this thermal head, the protective layer is formed of an inorganic material, and, on the protective layer, there is provided a cover layer formed of a resin material (refer to Patent Literature 1, for example).

CITATION LIST

Patent Literature

Patent Literature 1: Japanese Unexamined Patent Publication JP-A 5-57933 (1993)

SUMMARY OF INVENTION

A thermal head according to the disclosure comprises: a substrate; a heat generating section disposed on the substrate; an electrode disposed on the substrate so as to be electrically connected to the heat generating section; a protective layer which covers the heat generating section and part of the electrode, the protective layer being formed of an inorganic material; a cover layer disposed on the protective layer, the cover layer being formed of a resin material; and inorganic particles disposed on a surface of the protective layer so as to protrude from the surface. Moreover, the inorganic particles each comprise a first portion located inside the cover layer and a second portion located inside the protective layer.

A thermal printer according to the disclosure comprises: the thermal head mentioned above; a conveyance mechanism which conveys a recording medium onto the heat generating section; and a platen roller which presses the recording medium against a top of the heat generating section.

BRIEF DESCRIPTION OF DRAWINGS

FIGS. 7A and 7B show a thermal head according to a second embodiment, wherein FIG. 7A is a sectional view corresponding to FIG. 4B, and FIG. 7B is an enlarged schematic diagram showing an inorganic particle;

FIGS. 8A and 8B show a thermal head according to a third embodiment, wherein FIG. 8A is a sectional view corresponding to FIG. 4A, and FIG. 8B is a sectional view corresponding to FIG. 4B;

FIGS. 9A and 9B show an inorganic particle constituting the thermal head according to the third embodiment, wherein FIG. 9A is an enlarged schematic diagram showing an inorganic particle located at a surface of a protective layer, and FIG. 9B is an enlarged schematic diagram showing an inorganic particle located at a fourth interface; and FIGS. 10A and 10B show a thermal head according to a fourth embodiment, wherein FIG. 10A is a sectional view corresponding to FIG. 4A, and FIG. 10B is a sectional view corresponding to FIG. 4B.

DESCRIPTION OF EMBODIMENTS

<First Embodiment>

Figure 1:
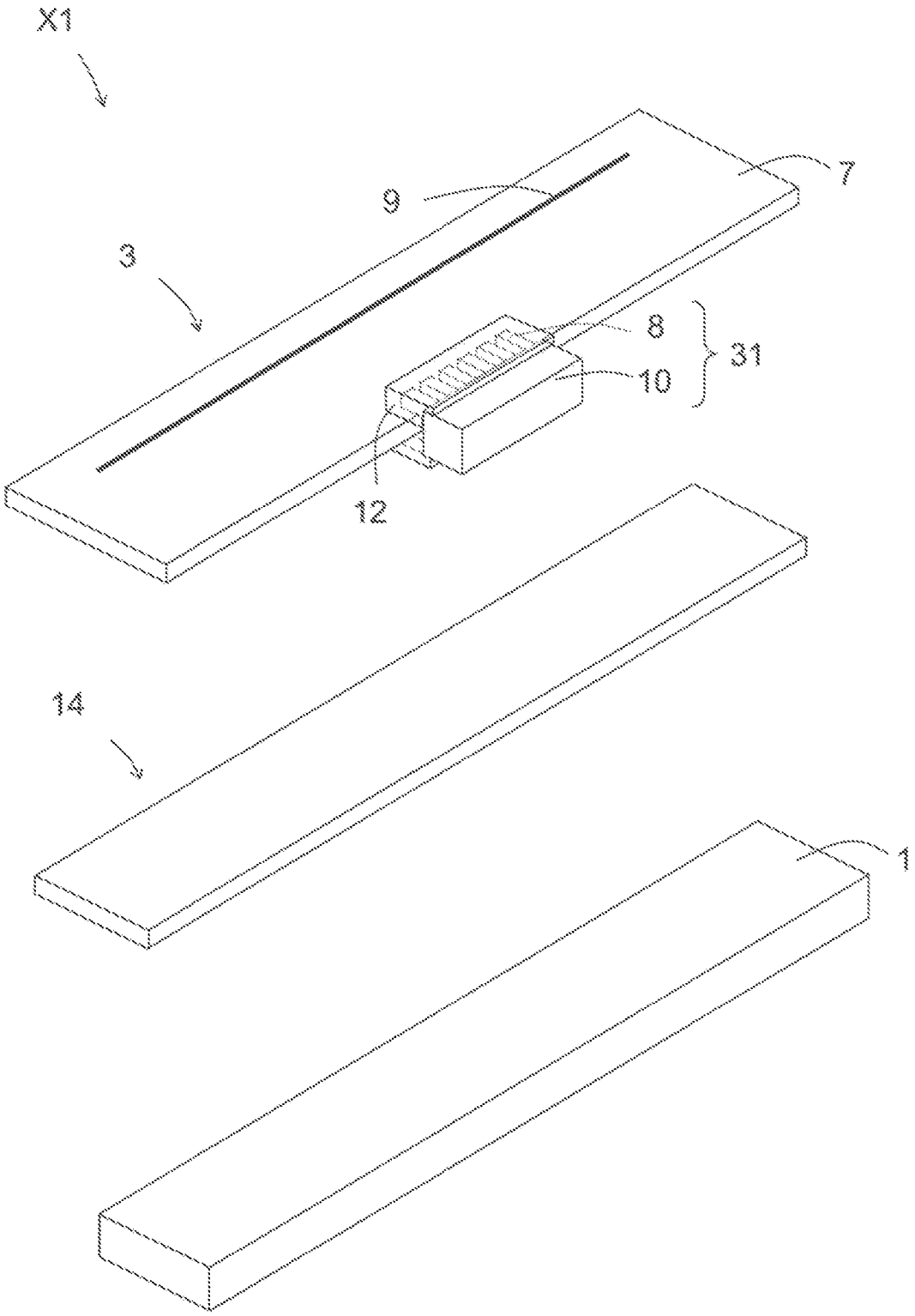
FIG. 1 is an exploded perspective view showing the general form of a thermal head according to a first embodiment.
Figure 2:
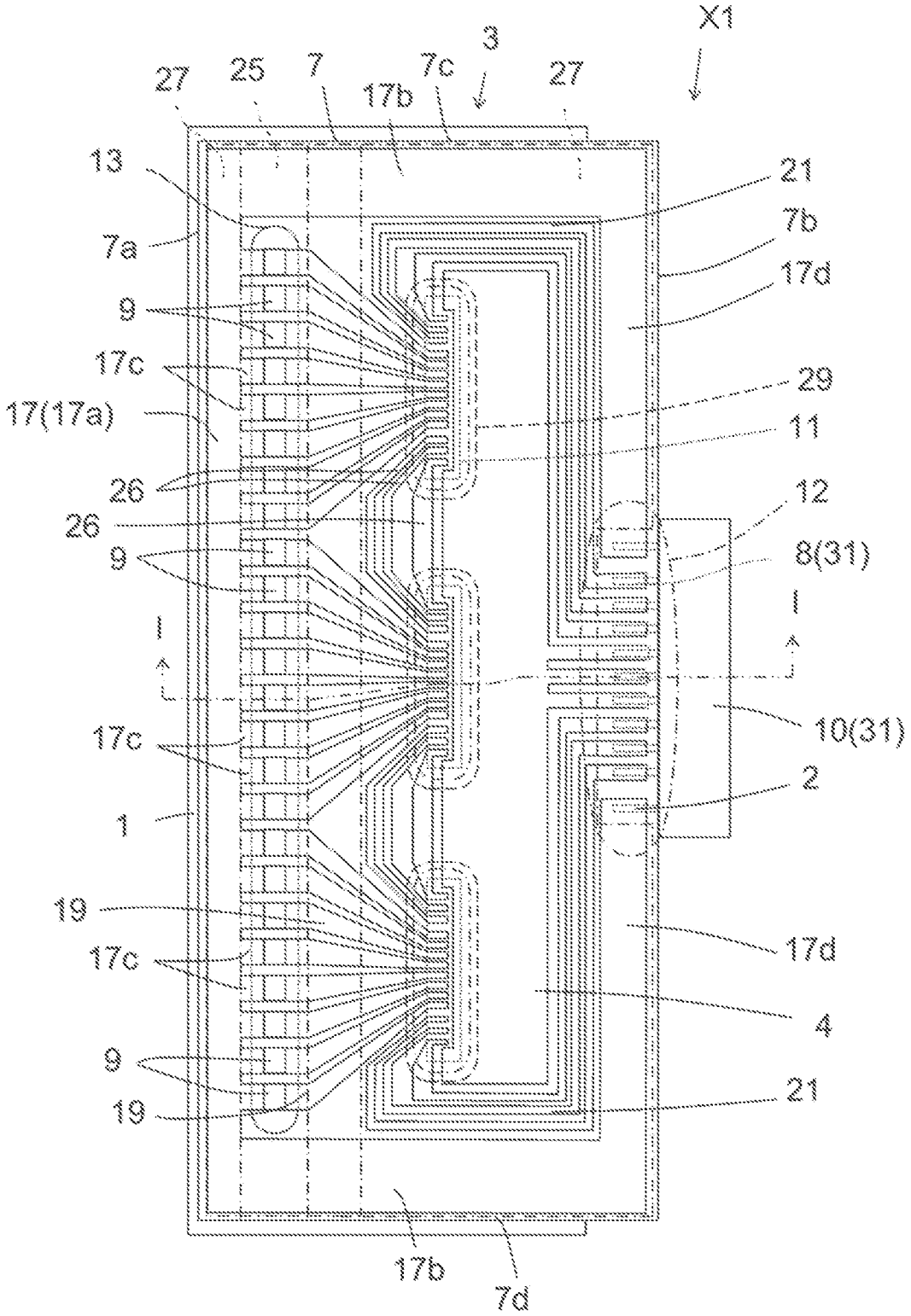
FIG. 2 is a plan view showing the general form of the thermal head shown in FIG. 1.

Hereinafter, a thermal head X1 will be described with reference to FIGS. 1 to 5. FIG. 1 schematically shows the structure of the thermal head X1. In FIG. 2, a protective layer 25, a cover layer 27, and a sealing member 12 are illustrated by alternate long and short dash lines.

The thermal head X1 comprises: a head base body 3; a connector 31; the sealing member 12; a heat dissipating plate 1; and a bonding member 14. In the thermal head X1, the head base body 3 is placed, via the bonding member 14, on the heat dissipating plate 1. The head base body 3 performs printing on a recording medium (not shown) by causing the heat generating section 9 to generate heat under application of external voltage. The connector 31 electrically connects the head base body 3 and the exterior thereof. The sealing member 12 joins the connector 31 and the head base body 3 together. The heat dissipating plate 1 is provided to dissipate heat evolved in the head base body 3. The bonding member 14 bonds the head base body 3 and the heat dissipating plate 1 together.

The heat dissipating plate 1 has a rectangular parallelepiped shape. The heat dissipating plate 1 is formed of a metal material such for example as copper, iron or aluminum, and functions to dissipate part of the heat evolved in the heat generating section 9 of the head base body 3 which part is not conducive to printing.

As shown in FIG. 1, the head base body 3 has a rectangular shape as seen in plan view, and, each member constituting the thermal head X1 is disposed on a substrate 7 of the head base body 3. The head base body 3 functions to perform printing on a recording medium (not shown) in response to an externally supplied electric signal.

Figure 3:
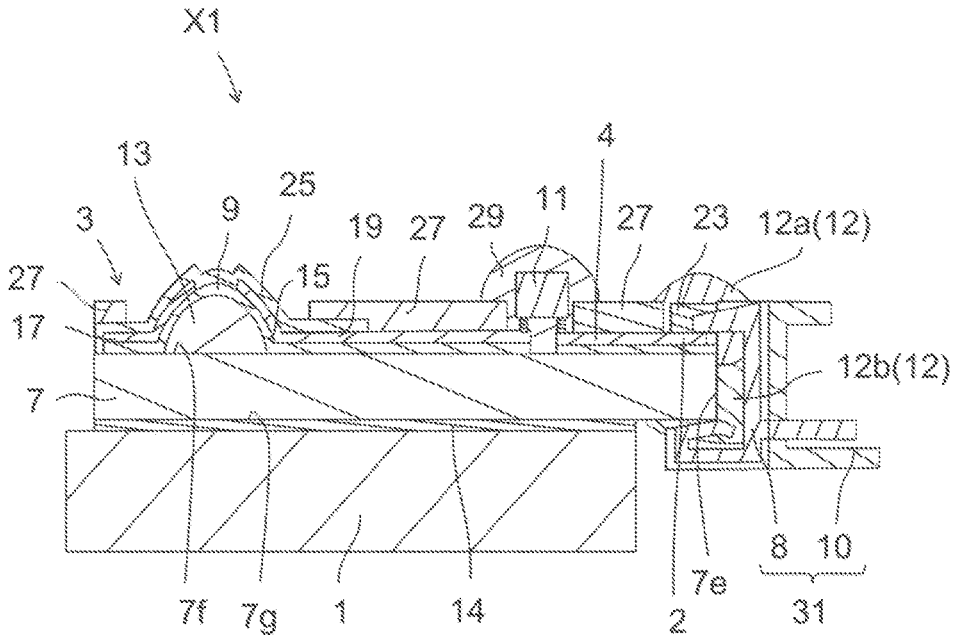
FIG. 3 is a sectional view taken along the line I-I shown in FIG. 2.

Now, each of the constituent members of the head base body 3 will be described with reference to FIGS. 1 to 3.

The substrate 7 is placed on the heat dissipating plate 1, and has a rectangular shape as seen in plan view. Thus, the substrate 7 is defined by a first long side 7*a*, a second long side 7*b*, a first short side 7*c*, a second short side 7*d*, a side surface 7*e*, a first surface 7*f*, and a second surface 7*g*. The side surface 7*e* is located on the connector 31 side. On the first surface 7*f*, the individual constituent members of the head base body 3 are provided. The second surface 7*g* is located on the heat dissipating plate 1 side. For example, the substrate 7 is formed of an electrically insulating material such as alumina ceramics, or a semiconductor material such as single-crystal silicon.

On the first surface 7*f* of the substrate 7, a heat storage layer 13 is provided. The heat storage layer 13 protrudes in a direction from the substrate 7 upward to form a protuberance. The heat storage layer 13 extends along a main scanning direction, and has a substantially semi-elliptical sectional profile. Moreover, the heat storage layer 13 serves to properly press a recording medium P under printing (refer to FIG. 5) against the protective layer 25 formed on the heat generating section 9. A height of the heat storage layer 13 from the substrate 7 is set to 15 to 90 μm.

The heat storage layer 13 is formed of glass having a low thermal conductivity, and temporarily stores part of the heat evolved in the heat generating section 9. Hence, the heat storage layer 13 is capable of shortening the time required to raise the temperature of the heat generating section 9, and thus functions to improve the thermal response characteristics of the thermal head X1. For example, the heat storage layer 13 is formed by applying a predetermined glass paste obtained by blending a suitable organic solvent in glass powder to the upper surface of the substrate 7 by heretofore known technique such as screen printing, and thereafter firing the glass paste.

An electrical resistance layer 15 is located on the substrate 7, as well as on the heat storage layer 13, and also, on the electrical resistance layer 15, various types of electrodes constituting the head base body 3 are provided. The electrical resistance layer 15 is patterned in the same configuration as that of each electrode constituting the head base body 3, and has exposed regions, each of which is an exposed electrical-resistance layer 15 region lying between a common electrode 17 and a discrete electrode 19. The exposed regions constitute the heat generating sections 9, and are arranged with predetermined spacing in array form on the heat storage layer 13. The electrical resistance layer 15 may be formed only in a region between the common electrode 17 and the discrete electrode 19.

The plurality of heat generating sections 9, while being illustrated in simplified form in FIG. 2 for convenience in explanation, are arranged at a density of 100 dpi (dot per inch) to 2400 dpi, for example. The electrical resistance layer 15 is formed of a material having a high electrical resistance value such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17 comprises: main wiring portions 17*a* and 17*d*; sub wiring portions 17*b*; and lead portions 17*c*. The common electrode 17 electrically connects the connector 31 and the plurality of heat generating sections 9. The main wiring portion 17*a* extends along the first long side 7*a* of the substrate 7. The sub wiring portions 17*b* extend along the first short side 7*c* and the second short side 7*d*, respectively, of the substrate 7. The lead portions 17*c* extend from the main wiring portion 17*a* toward the corresponding heat generating sections 9 on an individual basis. The main wiring portion 17*d* extends along the second long side 7*b* of the substrate 7.

The plurality of discrete electrodes 19 provide electrical connection between the heat generating section 9 and a driving IC 11. Moreover, the discrete electrodes 19 allow the plurality of heat generating sections 9 to fall into a plurality of groups, and provide electrical connection between each heat generating section 9 group and corresponding one of the driving ICs 11 assigned one to each group.

There are provided a plurality of IC-connector connection electrodes 21 for providing electrical connection between the driving IC 11 and the connector 31. The plurality of IC-connector connection electrodes 21 connected to the corresponding driving ICs 11 are composed of a plurality of wiring lines having different functions.

A ground electrode 4 is located so as to be surrounded by the discrete electrode 19, the IC-connector connection electrode 21, and the main wiring portion 17*d* of the common electrode 17. The ground electrode 4 is maintained at a ground potential of 0 V to 1 V.

A connection terminal 2 is located on the second long side 7*b* side of the substrate 7 to connect the common electrode 17, the discrete electrode 19, the IC-connector connection electrode and the ground electrode 4 to the connector 31. The connection terminal 2 is disposed corresponding to a connector pin 8. The connector pin 8 and the connection terminal 2 are connected to each other so that each connector pin 8 becomes electrically independent at the time of establishing connection with the connector 31.

A plurality of IC-IC connection electrodes 32 electrically connects adjacent driving ICs 11. The plurality of IC-IC connection electrodes 32 are each disposed corresponding to the IC-connector connection electrode 21 and transmit various signals to the adjacent driving ICs 11.

For example, various electrodes constituting the head base body 3 described above are formed by the following procedure, for example. Layers of materials which constitute the individual electrodes are laminated one after another on the heat storage layer 13 by thin-film forming technique such as sputtering. Next, the laminate body is worked into predetermined patterns by heretofore known technique such as photoetching to form the various electrodes. The various electrodes constituting the head base body 3 may be formed at one time through the same procedural steps.

As shown in FIG. 2, the driving IC 11 is disposed corresponding to each group of the plurality of heat generating sections 9 while being connected to the other end of the discrete electrode 19 and one end of the IC-connector connection electrode 21. The driving IC 11 functions to control the current-carrying condition of each heat generating section 9. As the driving IC 11, a switching member having a plurality of built-in switching elements may be used.

The driving IC 11, while being connected to the discrete electrode 19, the IC-IC connection electrode 32, and the IC-connector connection electrode 21, is sealed with a hard coating 29 formed of resin such as epoxy resin or silicone resin.

On the heat storage layer 13 located on the first surface 7*f* of the substrate 7 is formed the protective layer 25 which covers the heat generating section 9, part of the common electrode 17, and part of the discrete electrode 19.

The protective layer 25 serves to protect the heat generating section 9 and the covered areas of the common electrode 17 and the discrete electrode 19 against corrosion caused by adhesion of atmospheric water content, etc., or against wear caused by contact with a recording medium under printing. The protective layer 25 may be formed of an inorganic material such as SiN, $SiO_2$, SiON, SiC, or diamond-like carbon.

The protective layer 25 may be produced by thin-film forming technique such as sputtering, or thick-film forming technique such as screen printing.

On the substrate 7, there is provided a cover layer 27 which partly covers the common electrode 17, the discrete electrode 19, and the IC-connector connection electrode 21.

The cover layer 27 serves to protect the covered areas of the common electrode 17, the discrete electrode 19, the IC-IC connection electrode 32, and the IC-connector connection electrode 21 against oxidation caused by exposure to air, or corrosion caused by adhesion of atmospheric water content, etc. The cover layer may be formed of a resin material such as epoxy resin, polyimide resin, or silicone resin.

The connector 31 and the head base body 3 are secured to each other via the connector pin 8, a conductive member 23, and the sealing member 12. The conductive member 23 is disposed between the connection terminal 2 and the connector pin 8, and, exemplary of the conductive member 23 is solder or an anisotropic conductive adhesive. Note that the conductive member 23 does not necessarily have to be provided, and that a Ni-, Au-, or Pd-plating layer (not shown in the drawings) may be interposed between the conductive member 23 and the connection terminal 2.

The connector 31 comprises the plurality of connector pins 8 and a housing 10 which receives the plurality of connector pins 8. Each of the plurality of connector pins 8 has one side exposed from the housing 10, and another side received within the housing 10. The plurality of connector pins 8 are electrically connected to the connection terminal 2 of the head base body 3, and are electrically connected with the various electrodes of the head base body 3.

The sealing member 12 comprises a first sealing member 12*a* and a second sealing member 12*b*. The first sealing member 12*a* is located on the first surface 7*f* of the substrate 7, and the second sealing member 12*b* is located on the second surface 7*g* of the substrate 7. The first sealing member 12*a* is disposed so as to seal the connector pin 8 and the various electrodes, and the second sealing member 12*b* is disposed so as to seal an area where the connector pin 8 and the substrate 7 make contact with each other.

The sealing member 12 is provided so as not to expose the connection terminal 2 and the connector pin 8 to the outside, and may be formed of a thermosetting epoxy resin, an ultraviolet-curable resin, or a visible light-curable resin, for example. The first sealing member 12*a* and the second sealing member 12*b* may be formed either of the same material or of different materials.

The bonding member 14 is placed on the heat dissipating plate 1 to bond the second surface 7*g* of the head base body 3 with the heat dissipating plate 1. Exemplary of the bonding member 14 is a double-faced tape or a resin-based adhesive.

Figure 4A:
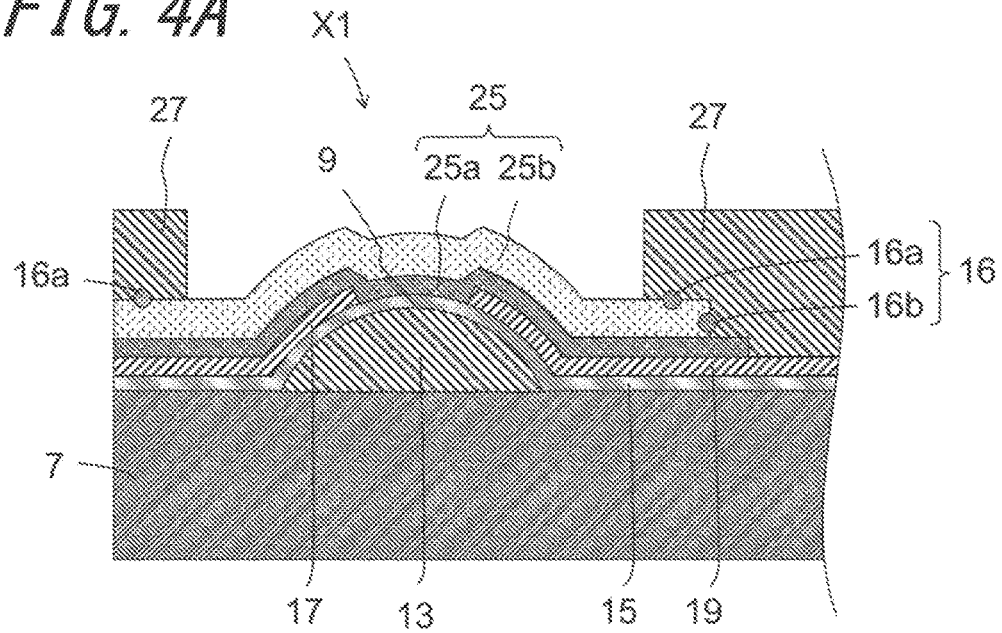
FIG. 4A is an enlarged sectional view showing part of the thermal head shown in FIG. 1.
Figure 4B:
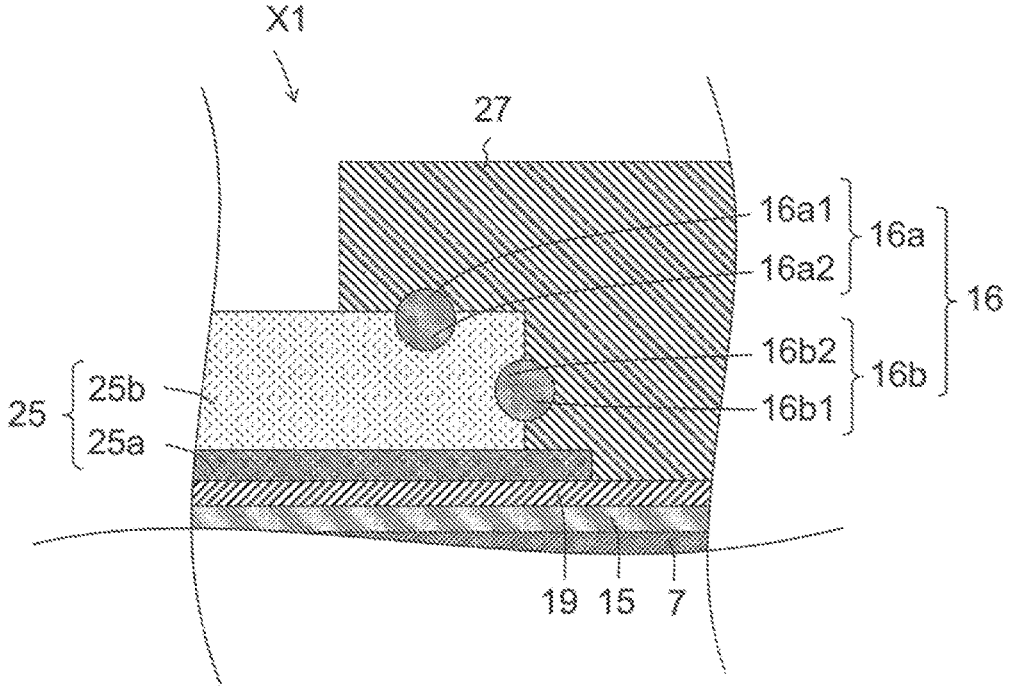
FIG. 4B is a sectional view showing the part of FIG. 4A in further enlarged dimension.
Figure 5:
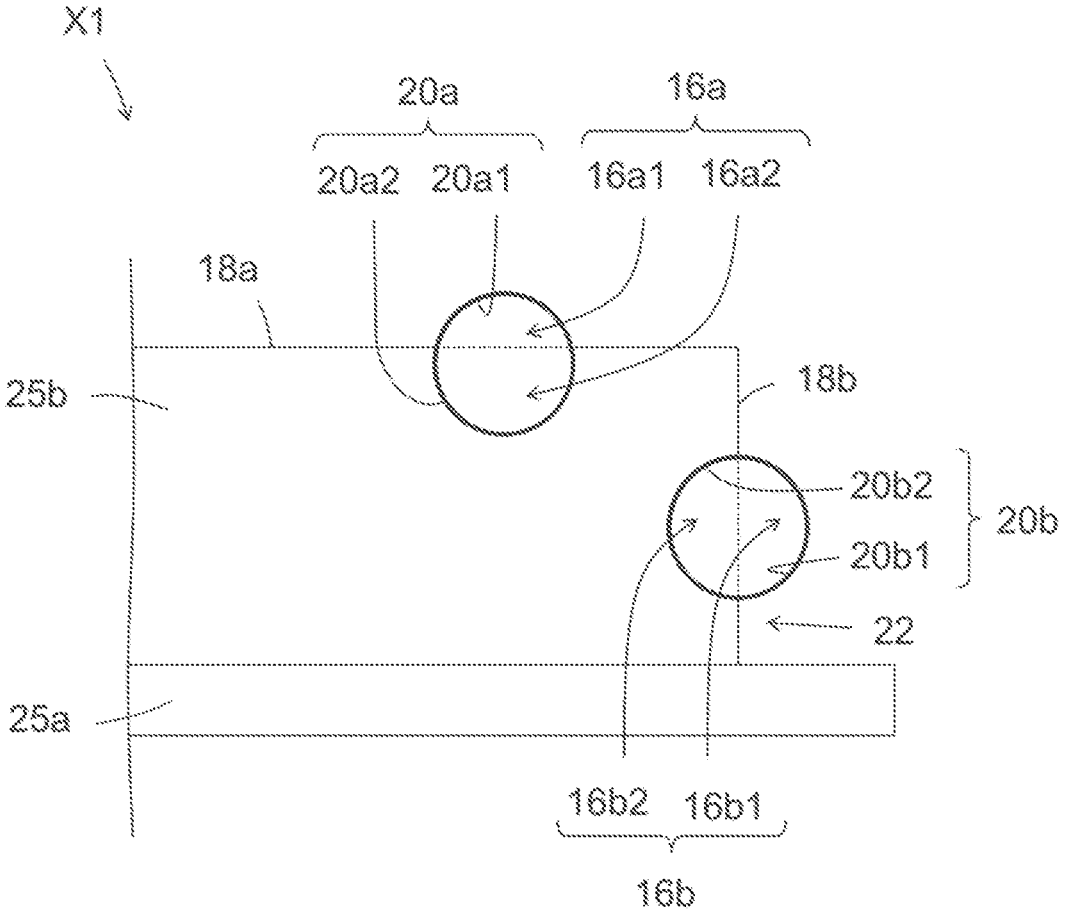
FIG. 5 is an enlarged schematic diagram showing inorganic particles.

Referring to FIGS. 4A, 4B and 5, the protective layer 25, the cover layer 27, and an inorganic particle 16 will be described in detail. In FIG. 5, the illustration of the cover layer 27 (refer to FIGS. 4A and 4B) will be omitted.

The protective layer 25 comprises an insulating layer 25*a* and a conductive layer 25*b*. The insulating layer 25*a* is located on the heat generating section 9, on part of the common electrode 17, and on part of the discrete electrode 19.

The insulating layer 25*a* is formed of a material having high specific resistance, and may thus be formed of, for example, $SiO_2$, SiN, or SiON. A thickness of the insulating layer 25*a* may be set to 0.1 μm to 10 μm, for example. With the placement of the insulating layer 25*a*, it is possible to insulate the plurality of heat generating sections 9 arranged in the main scanning direction from each other. The insulating layer 25*a* may be formed by screen printing technique, sputtering technique, or ion plating technique, for example.

The conductive layer 25*b* is formed of a material which is lower in specific resistance than the insulating layer 25*a*, and may thus be formed of, for example, Tin, TiCN, or TaSiO. The conductive layer 25*b* has a top surface 18*a* and a side surface 18*b*.

A thickness of the conductive layer 25*b* may be set to 2 μm to 15 μm, for example. The placement of the conductive layer 25*b* makes it possible to eliminate static electricity arising from the contact of the protective layer 25 with the recording medium P (refer to FIG. 6). The conductive layer 25*b* may be formed by screen printing technique, sputtering technique, or ion plating technique, for example.

The inorganic particle 16 is disposed on the top surface 18*a* or the side surface 18*b* of the protective layer 25. An inorganic particle 16*a* protrudes from the top surface 18*a* of the conductive layer 25*b* toward the cover layer 27. An inorganic particle 16*b* protrudes from the side surface 18*b* of the conductive layer 25*b* toward the cover layer 27. The inorganic particles 16 range in particle size from 5 μm to 300 μm, and may be formed of metal, alloy, or ceramics. In a case where the inorganic particle 16 is formed of the same material as that constituting the conductive layer 25*b*, stress is less likely to be generated in the interior of the conductive layer 25*b*. More specifically, where the inorganic particle 16 is formed of such elements as Ti, C, N, and Si, stress is less likely to be generated in the interior of the conductive layer 25*b*.

The inorganic particle 16*a* protrudes from the top surface 18*a* of the conductive layer 25*b* toward the cover layer 27. The inorganic particle 16*a* comprises a first portion 16*a*1 located inside the cover layer 27 and a second portion 16*a*2 located inside the conductive layer 25*b*. In other words, the inorganic particle 16*a* is located on the top surface 18*a* of the conductive layer 25*b*, and the second portion 16*a*2 is embedded within the conductive layer 25*b*.

The inorganic particle 16*a* makes contact with the cover layer 27 and the conductive layer 25*b* through an interface 20*a*. The interface 20*a* comprises a first interface 20*a*1 and a second interface 20*a*2. The first interface 20*a*1 defines a boundary face between the first portion 16*a*1 and the cover layer 27. The second interface 20*a*2 defines a boundary face between the second portion 16*a*2 and the conductive layer 25*b*.

The inorganic particle 16*b* protrudes from the side surface 18*b* of the conductive layer 25*b* toward the cover layer 27. The inorganic particle 16*b* comprises a first portion 16*b*1 located inside the cover layer 27 and a second portion 16*b*2 located inside the conductive layer 25*b*. In other words, the inorganic particle 16*b* is located on the side surface 18*b* of the conductive layer 25*b*, and the second portion 16*b*2 is embedded within the conductive layer 25*b*. A region 22 is formed between the first portion 16*b*1 and the insulating layer 25*a*.

The inorganic particle 16*b* makes contact with the cover layer 27 and the conductive layer 25*b* through an interface 20*b*. The interface 20*b* comprises a first interface 20*b*1 and a second interface 20*b*2. The first interface 20*b*1 defines a boundary face between the first portion 16*b*1 and the cover layer 27. The second interface 20*b*2 defines a boundary face between the second portion 16*b*2 and the conductive layer 25*b*.

The protective layer 25 is formed of an inorganic material. The cover layer 27 disposed on the protective layer 25 is formed of an organic material. Therefore, the strength of adhesion between the protective layer 25 and the cover layer 27 is so low that the cover layer 27 may be separated from the protective layer 25.

The inorganic particle 16*a* is located on the top surface 18*a* of the conductive layer 25*b* so as to protrude from the top surface 18*a*, and comprises the first portion 16*a*1 and the second portion 16*a*2. Thus, the first portion 16*a*1 kept in contact with the cover layer 27 is joined to the cover layer 27, and the second portion 16*a*2 is located inside the conductive layer 25*b*, wherefore the inorganic particle 16*a* can enhance the adhesion between the conductive layer 25*b* and the cover layer 27.

That is, the resin material constituting the cover layer is applied onto the conductive layer 25*b* so that the resin material wraps around the surface of the first portion 16*a*1 of the inorganic particle 16*a*. This makes it possible to enhance the adhesion between the first portion 16*a*1 and the cover layer 27. Moreover, due to the second portion 16*a*2 being embedded within the conductive layer 25*b*, even if an external force is exerted upon the cover layer 27, the second portion 16*a*2 can stay in the conductive layer 25*b*, and thus the inorganic particle 16*a* is less likely to be separated from the conductive layer 25*b*. This makes it possible to enhance the adhesion between the conductive layer 25*b* and the cover layer 27.

As shown in FIGS. 4A and 4B, the insulating layer 25*a* is made larger in width than the conductive layer 25*b*, as seen in sectional view. This makes it possible to reduce the possibility of electrical short circuit caused by the contact of the conductive layer 25*b* with the heat generating section 9, the common electrode 17, and the discrete electrode 19. It is possible to reduce the possibility of electrical short circuit by adjusting the width of the insulating layer 25*a* to be 1.1 to 1.5 times the width of the conductive layer 25*b*. As employed herein "as seen in sectional view" means "as observed in a plane of section of the thermal head X1 taken along a sub-scanning direction".

The inorganic particle 16*b* is located on the side surface 18*b* of the conductive layer 25*b* so as to protrude from the side surface 18*b*, and comprises the first portion 16*b*1 and the second portion 16*b*2. Moreover, the region 22 is left between the first portion 16*b*1 and the insulating layer 25*a*. The resin material constituting the cover layer 27 enters the region 22 between the first portion 16*b*1 and the insulating layer 25*a*.

Hence, the cover layer 27 is located in the region 22 so as to wrap around the first portion 16*b*1. In consequence, even when an external force is exerted upon the cover layer 27, a part of the cover layer 27 which lies in the region 22 serves to get caught in the first portion 16*b*1 against the external force. Thus, the cover layer 27 is less likely to be separated from the conductive layer 25*b*.

For example, the protective layer 25 may be formed by the following procedure.

A mask is set on the substrate 7 patterned with the various electrodes, and the insulating layer 25*a* is formed by sputtering technique. Next, after adjusting the size of mask opening to be smaller than that in the case where the insulating layer 25*a* is formed, the conductive layer 25*b* is formed by sputtering technique.

Following the formation of the conductive layer 25*b* using the sputtering technique, for example, by carrying out plasma spraying or electric arc spraying of the inorganic particles 16, it is possible to contain the inorganic particles 16 in the conductive layer 25*b*. Moreover, the inorganic particles 16 are contained in the conductive layer 25*b* by, for example, spraying technique, and can thus be dispersed in random fashion in the conductive layer 25*b*. In this way, the conductive layer 25*b* containing the inorganic particle 16 therein can be produced by repeating sputtering process and plasma spraying process, for example.

Then, in order to prepare the cover layer 27, resin is applied onto the conductive layer 25*b* using screen printing technique and then cured, so that the thermal head X1 can be produced. In the case of forming the conductive layer 25*b* by thin-film forming technique as described above, the conductive layer 25*b* exhibits high membrane stress, which leads to a reduction in the strength of adhesion with the cover layer 27, and yet, the conductive layer 25*b* contains the inorganic particles 16, wherefore the adhesion between the conductive layer 25*b* and the cover layer 27 can be enhanced.

Moreover, in the case of forming the conductive layer 25*b* by screen printing technique, the conductive layer 25*b* is printed, via a predetermined printing mask, on the substrate 7 formed with the insulating layer 25*a*. Next, the inorganic particles 16 are sprayed at random and dried. Subsequently, the protective layer 25 containing the inorganic particles 16 is fired, whereupon the conductive layer 25*b* can be formed. The conductive layer 25*b* containing the inorganic particles 16*a* and 16*b* may be produced by repeating printing of the conductive layer 25*b* and spray of the inorganic particles 16.

Although the protective layer 25 is, as exemplified, composed of the insulating layer 25*a* and the conductive layer 25*b*, the protective layer 25 does not necessarily have to include the insulating layer 25*a* and the conductive layer 25*b*. That is, the protective layer 25 may be made in single-layer form. In another alternative, the insulating layer 25*a* or the conductive layer 25*b* may be made in multi-layer form.

Figure 6:
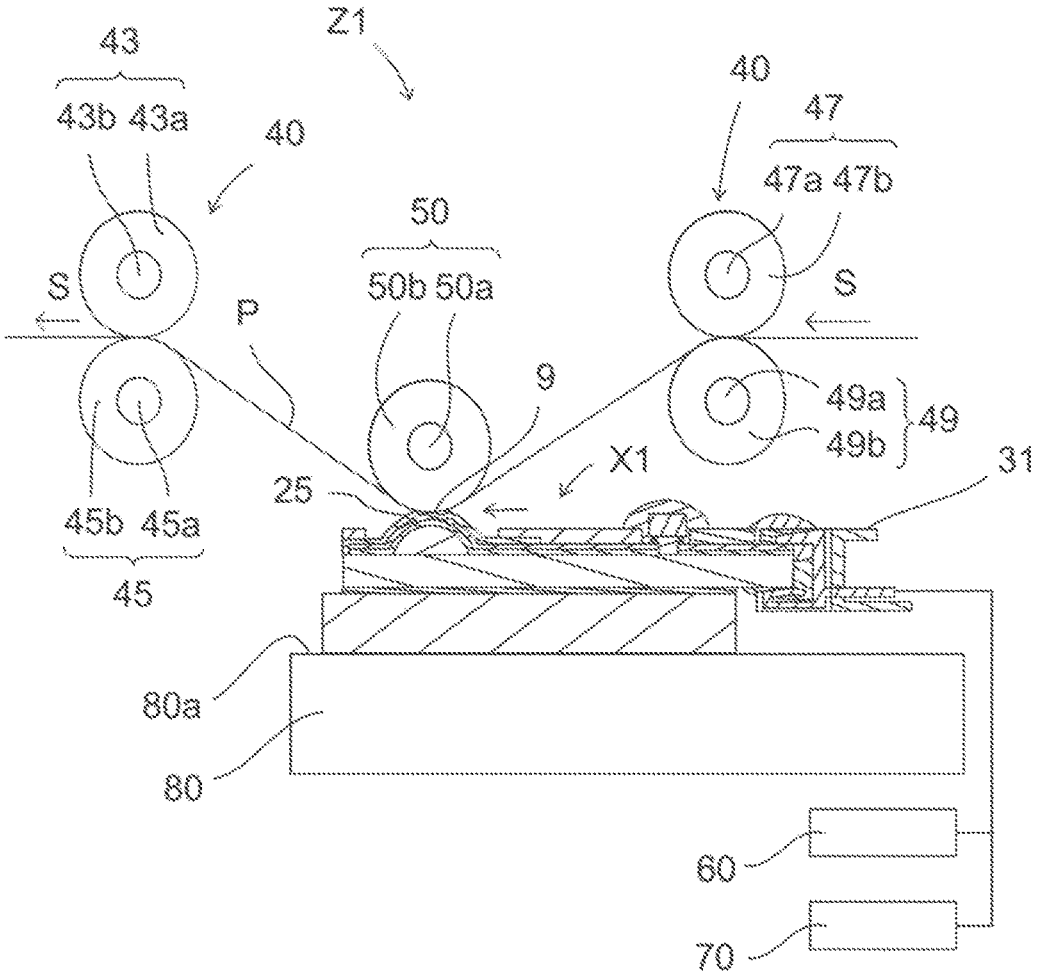
FIG. 6 is a schematic view showing a thermal printer according to the first embodiment.

Next, a thermal printer Z1 will be described with reference to FIG. 6.

The thermal printer Z1 according to the embodiment comprises: the thermal head X1 described above; a conveyance mechanism 40; a platen roller 50; a power supply device 60; and a control unit 70. The thermal head X1 is attached to a mounting face 80*a* of a mounting member 80 disposed in a housing (not shown) for the thermal printer Z1. The thermal head X1 is mounted on the mounting member 80 so as to be oriented along the main scanning direction which is perpendicular to a conveying direction S of the recording medium P which will hereafter be described.

The conveyance mechanism 40 comprises a driving section (not shown) and conveying rollers 43, 45, 47 and 49. The conveyance mechanism 40 serves to convey the recording medium P such as thermal paper or ink-transferable image-receiving paper, in a direction indicated by the arrow S shown in FIG. 6 so as to move the recording medium P onto the protective layer 25 located on the plurality of heat generating sections 9 of the thermal head X1. The driving section functions to drive the conveying rollers 43, 45, 47 and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, for example. Although not shown in the drawing, when using ink-transferable image-receiving paper or the like as the recording medium P, the recording medium P is conveyed together with an ink film which lies between the recording medium P and the heat generating section 9 of the thermal head X1.

The platen roller 50 functions to press the recording medium P against the top of the protective layer 25 located on the heat generating section 9 of the thermal head X1. The platen roller 50 is disposed so as to extend along a direction perpendicular to the conveying direction S of the recording medium P, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, for example.

The power-supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

The thermal printer Z1 performs predetermined printing on the recording medium P by, while pressing the recording medium P against the top of the heat generating section 9 of the thermal head X1 by the platen roller 50, conveying the recording medium P onto the heat generating section 9 by the conveyance mechanism 40, and also operating the power-supply device 60 and the control unit 70 so as to enable the heat generating sections 9 to selectively generate heat. When using image-receiving paper or the like as the recording medium P, printing on the recording medium P is performed by thermally transferring the ink of the ink film (not shown), which is conveyed together with the recording medium P, onto the recording medium P.

<Second Embodiment>

Figure 7A:
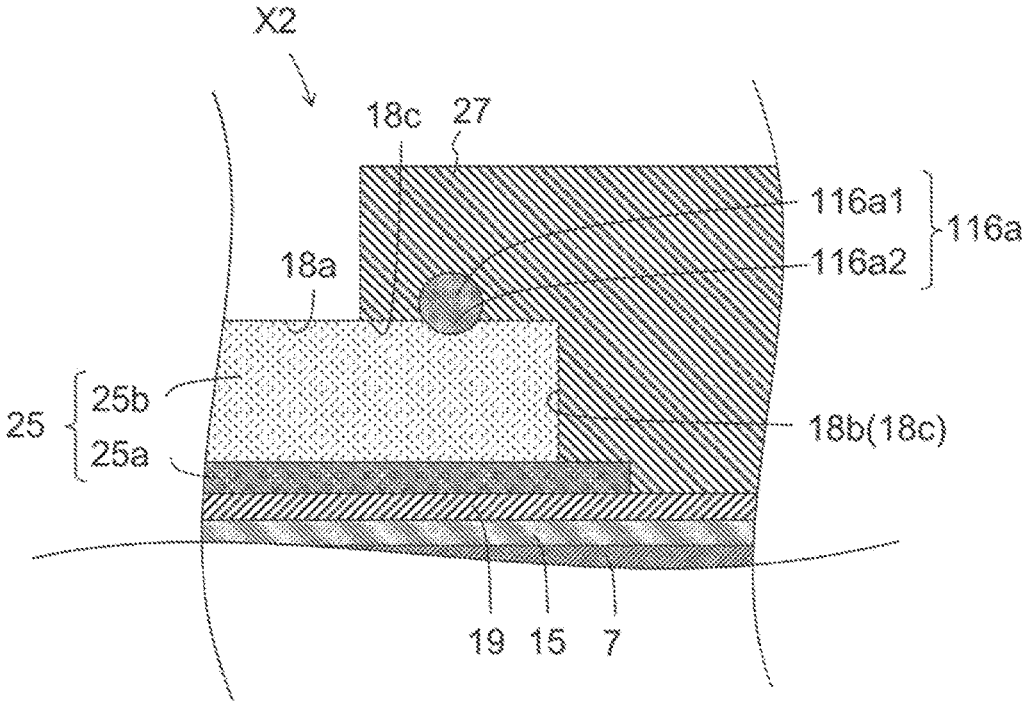
Figure 7B:
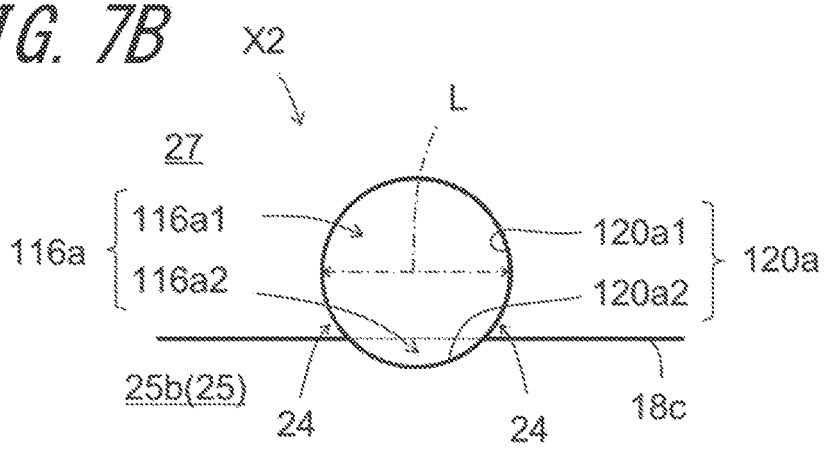
Figure 8A:
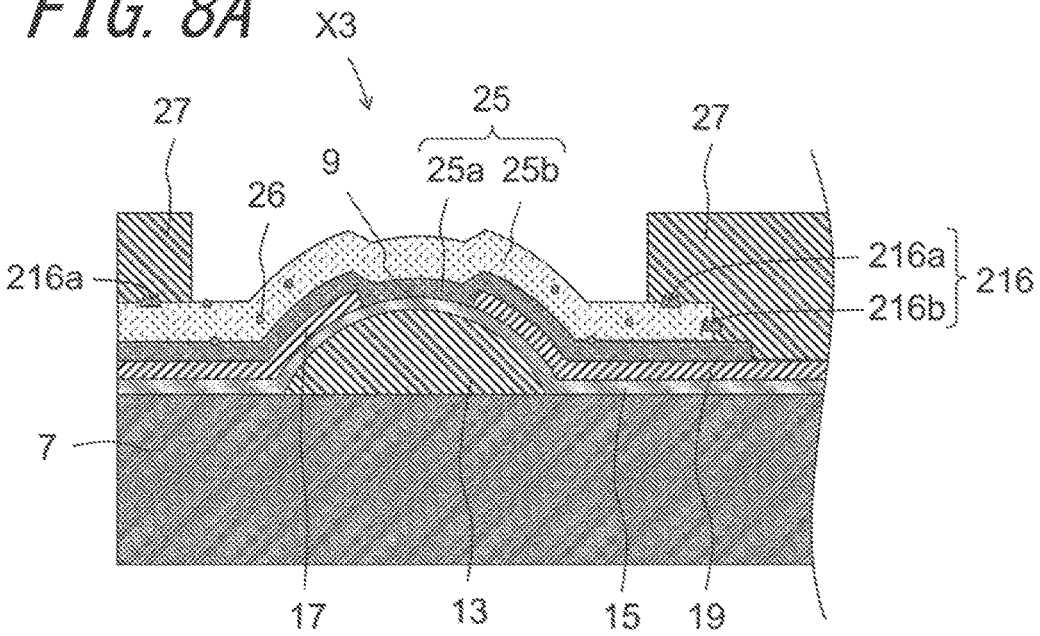
Figure 8B:
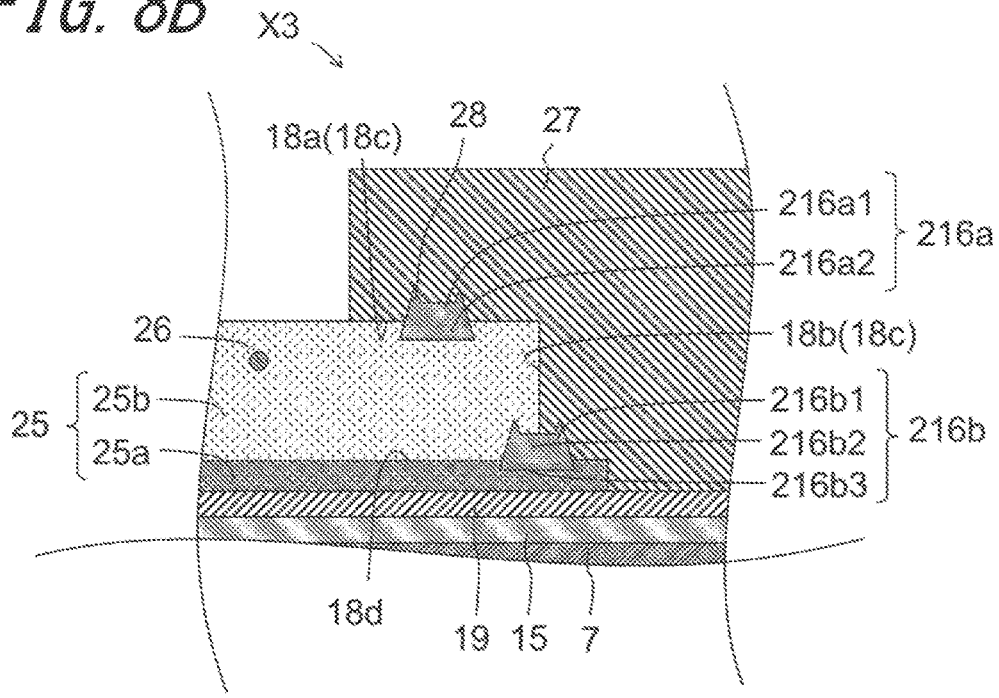
Figure 9A:
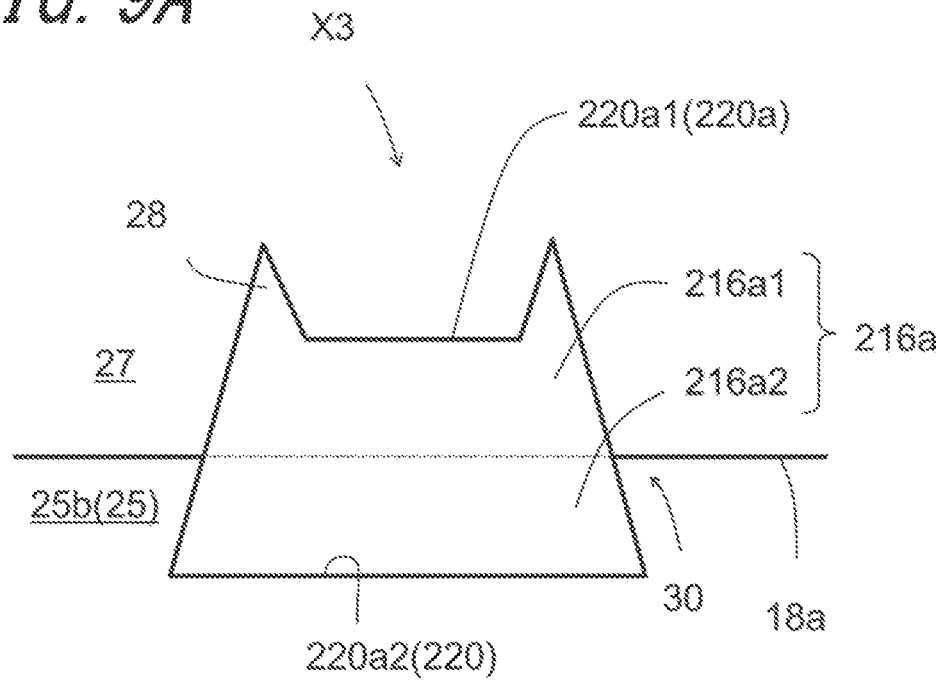
Figure 9B:
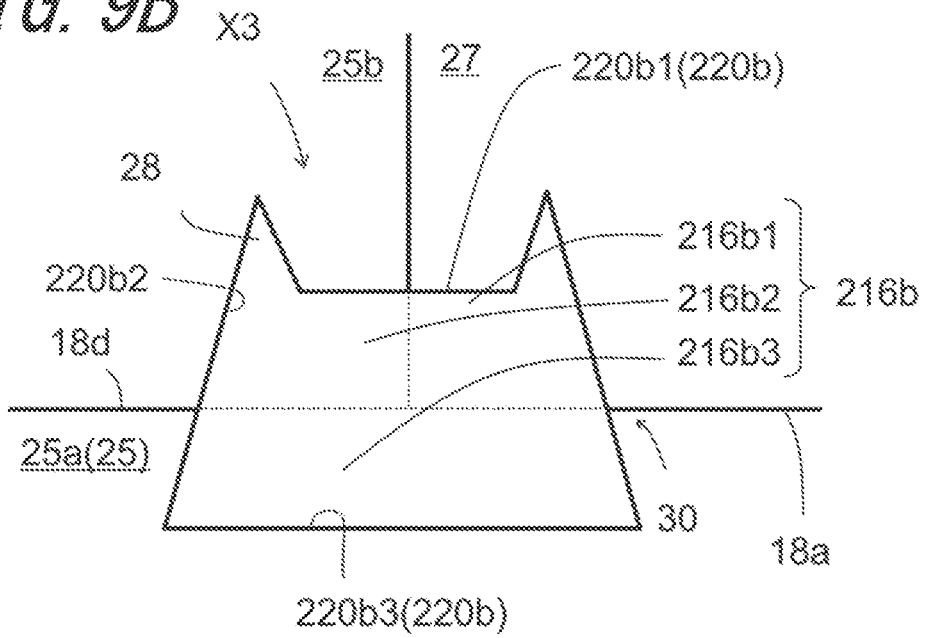

A thermal head X2 will be described with reference to FIGS. 7A and 7B. The same members as those of the thermal head X1 will be identified with the same reference symbols throughout the following description. In the thermal head X2, an inorganic particle 116 differs from the inorganic particle 16 of the thermal head X1.

The protective layer 25 has the top surface 18*a*, the side surface 18*b*, and a third interface 18*c*. The third interface 18*c* is formed in the top surface 18*a*, as well as at the side surface 18*b*. The third interface 18*c* defines a boundary face between the protective layer 25 and a cover layer 27.

There is provided a conductive layer 25*b* containing an inorganic particle 116*a*. The inorganic particle 116*a* is located on the third interface 18*c* of the conductive layer 25*b* so as to protrude from the third interface 18*c* toward the cover layer 27. The inorganic particle 116*a* comprises a first portion 116*a*1 located inside the cover layer 27 and a second portion 116*a*2 located inside the conductive layer 25*b*.

Moreover, the inorganic particle 116*a* makes contact with the cover layer 27 and the conductive layer 25*b* through an interface 120*a*. The interface 120*a* comprises a first interface 120*a*1 and a second interface 120*a*2. The first interface 120*a*1 defines a boundary face between the first portion 116*a*1 and the cover layer 27, and the second interface 120*a*2 defines a boundary face between the second portion 116*a*2 and the conductive layer 25*b*.

In the inorganic particle 116*a*, the first interface 120*a*1 is made larger in length than the second interface 120*a*2, as seen in sectional view. This makes it possible to increase the area of contact between the inorganic particle 116*a* and the cover layer 27, and thereby enhance the adhesion between the inorganic particle 116*a* and the cover layer 27.

The length of the second interface 120*a*2 is reduced by an amount corresponding to an increase in the length of the first interface 120*a*1. However, since the inorganic particle 116*a* and the conductive layer 25*b* are each formed of an inorganic material, it does not occurs that the strength of adhesion between the inorganic particle 116*a* and the conductive layer 25*b* is decreased to a large extent. That is, in the inorganic particle 116*a*, by increasing the area of contact between the cover layer 27 and the first portion 116*a*1 which is less adherable thereto, the cover layer 27 can be less likely to be separated from the conductive layer 25*b*.

Each and every inorganic particle 116*a* contained in the conductive layer 25*b* does not necessarily have to include such a configuration that the first interface 120*a*1 is made larger in length than the second interface 120*a*2, as seen in sectional view. As long as at least one inorganic particle 116*a* is designed so that the first interface 120*a*1 is made larger in length than the second interface 120*a*2, it is possible to suppress separation of the cover layer 27.

Moreover, a part of the first portion 116*a*1 which has a maximum diameter L is located on the cover layer 27 side beyond the third interface 18*c*, as seen in sectional view. This creates a region 24 between the first portion 116*b*1 and the insulating layer 25*a*, and, the resin material constituting the cover layer 27 enters the region 24 between the first portion 116*b*1 and the insulating layer 25*a*.

Hence, the cover layer 27 is located in the region 24 so as to wrap around the first portion 116*b*1. In consequence, even when an external force is exerted upon the cover layer 27, a part of the cover layer 27 which lies in the region 24 serves to get caught in the first portion 16*b*1 against the external force. Thus, the cover layer 27 is less likely to be separated from the conductive layer 25*b*.

As employed herein "as seen in sectional view" means "as observed in a plane of section of the construction taken along the sub-scanning direction" and "a part of the first portion 116*a*1 which has the maximum diameter L as seen in sectional view" means "a part of the plane of broken-out section of the inorganic particle 116 sectioned along a given plane in the sub-scanning direction which part has the maximum diameter L".

<Third Embodiment>

A thermal head X3 will be described with reference to FIGS. 8A, 8B, 9A and 9B. The thermal head X3 has a first inorganic particle 216 and a second inorganic particle 26.

The protective layer 25 has the top surface 18*a* and the side surface 18*b*. Moreover, the protective layer 25 has a third interface 18*c* lying between a conductive layer 25*b* and a cover layer 27. Besides, the protective layer 25 has a fourth interface 18*d* lying between an insulating layer 25*a* and the conductive layer 25*b*.

First inorganic particles 216*a* and 216*b* are located inside the conductive layer 25*b*, with part thereof protruding from the conductive layer 25*b*, and, the second inorganic particle 26 is located inside the conductive layer 25*b*.

The second inorganic particles 26 are located inside the conductive layer 25*b*. The second inorganic particles 26 in spherical form are made smaller in average particle size than the first inorganic particles 216. A particle size of the second inorganic particles 26 is set to 1 μm to 30 μm. The second inorganic particles 26 may also be formed so as to protrude from the top surface 18*a* or the side surface 18*b* of the conductive layer 25*b*.

The thermal head X3 includes the first inorganic particles 216, and the second inorganic particles 26 which are made smaller in average particle size than the first inorganic particles 216. In this case, while the strength of adhesion between the conductive layer 25*b* and the cover layer 27 is increased by the first inorganic particles 216, a decrease in hardness in the conductive layer 25*b* can be reduced.

That is, in a case where the first inorganic particle 216 and the second inorganic particle 26 are lower in hardness than the conductive layer 25*b*, the placement of the first inorganic particles 216 having a larger average particle size allows enhancement in adhesion between the conductive layer 25*b* and the cover layer 27. In addition, the placement of the second inorganic particles 26 having a smaller average particle size is less likely to decrease the hardness of the conductive layer 25*b*.

For example, the average particle size of the first inorganic particles 216 and the average particle size of the second inorganic particles 26 may be measured by the following method. The average particle size of the first inorganic particles 216 may be determined by cutting the thermal head X3 taken along the sub-scanning direction and calculating the average of the particle sizes of three first inorganic particles 216 arbitrarily taken from those which appear at the plane of section of the thermal head X3. The same holds true for the second inorganic particles 26.

The first inorganic particle 216*a* is provided so as to protrude from the top surface 18*a* of the conductive layer 25*b* toward the cover layer 27. The first inorganic particle 216*a* comprises a first portion 216*a*1 which is located inside the cover layer 27 and makes contact with the cover layer 27, and a second portion 216*a*2 which is located inside the conductive layer 25*b*. In the first inorganic particle 216*a*, the first portion 216*a*1 is provided with a projection 28. The projection 28 is provided so as to protrude from a flat area of the first inorganic particle 216*a* which flat area is provided on the cover layer 27 side, toward the cover layer 27.

The first inorganic particle 216*a* makes contact with the cover layer 27 and the conductive layer 25*b* through an interface 220*a*. A first interface 220*a*1 defines a boundary face between the first portion 216*a*1 and the cover layer 27. A second interface 220*a*2 defines a boundary face between the second portion 216*a*2 and the conductive layer 25*b*.

The first inorganic particle 216*a* has substantially the shape of a trapezoid whose long side is located on the conductive layer 25*b* side, as seen in sectional view. In the first inorganic particle 216*a*, the first portion 216*a*1 has the projection 28 protruding in a direction away from the conductive layer 25*b*. This makes it possible to increase the area of contact between the first portion 216*a*1 and the cover layer 27. As a result, the cover layer 27 is less likely to peel off.

In the first inorganic particle 216*a*, a maximum length of the second portion 216*a*2 in the sub-scanning direction is greater than a maximum length of the first portion 216*a*1 in the sub-scanning direction. This creates a region 30 between the second interface 220*a*2 and the top surface 18*a* of the conductive layer 25*b*, and, the conductive layer 25*b* is present in the region 30.

Hence, even when an external force is exerted upon the cover layer 27, the second portion 216*a*2 of the first inorganic particle 216*a* gets caught in a part of the conductive layer 25*b* which lies in the region 30, and the first inorganic particle 216*a* is less likely to be separated from the conductive layer 25*b*. In consequence, the cover layer 27 is less likely to be separated from the conductive layer 25*b*.

The first inorganic particle 216*b* is provided so as to protrude from the side surface 18*b* of the conductive layer 25*b* toward the cover layer 27. In addition, the first inorganic particle 216*b* is provided so as to protrude from the fourth interface 18*d* toward the insulating layer 25*a*. The first inorganic particle 216*b* comprises a first portion 216*b*1, a second portion 216*b*2, and a third portion 216*b*3.

The first portion 216*b*1 is located inside the cover layer 27 and makes contact with the cover layer 27 through an interface 220*b*1. The second portion 216*b*2 is located inside the conductive layer 25*b* and makes contact with the conductive layer 25*b* through an interface 220*b*2. The third portion 216*b*3 is located inside the insulating layer 25*a* and makes contact with the insulating layer 25*a* through an interface 220*b*3.

The first inorganic particle 216*b* has the third portion 216*b*3 located inside the insulating layer 25*a*. This makes it possible to enhance the adhesion between the insulating layer 25*a* and the conductive layer 25*b*. That is, since the third portion 216*b*3 has the first inorganic particle 216*b*, it is possible to enhance the adhesion between the insulating layer 25*a* and the first inorganic particle 216*b*, and the conductive layer 25*b* is less likely to be separated from the insulating layer 25*a*.

<Fourth Embodiment>

Figure 10A:
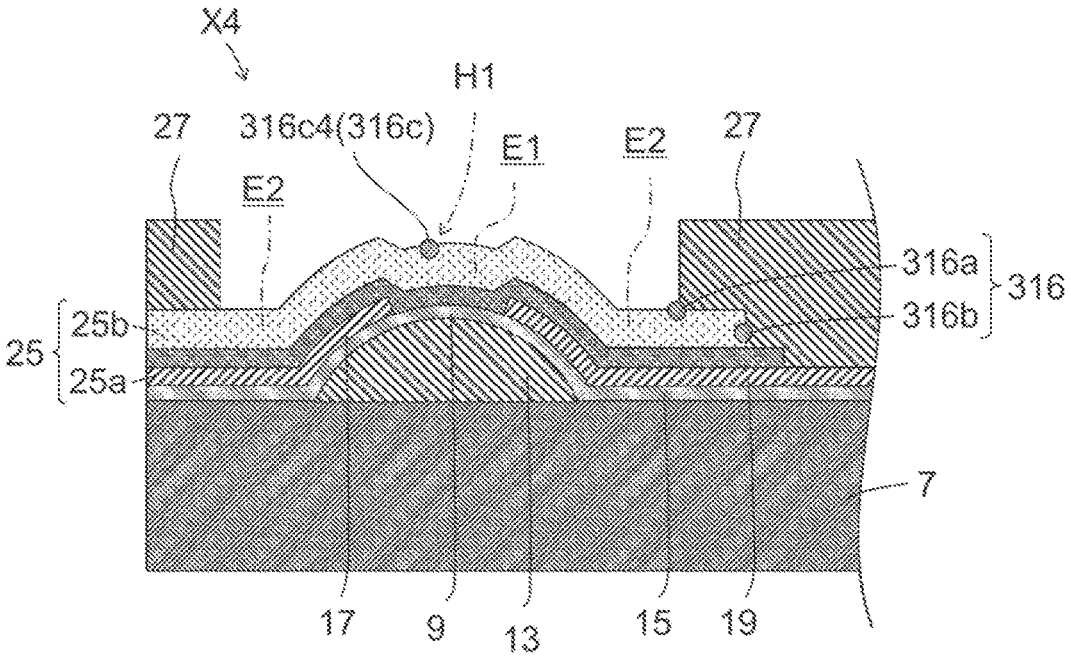
Figure 10B:
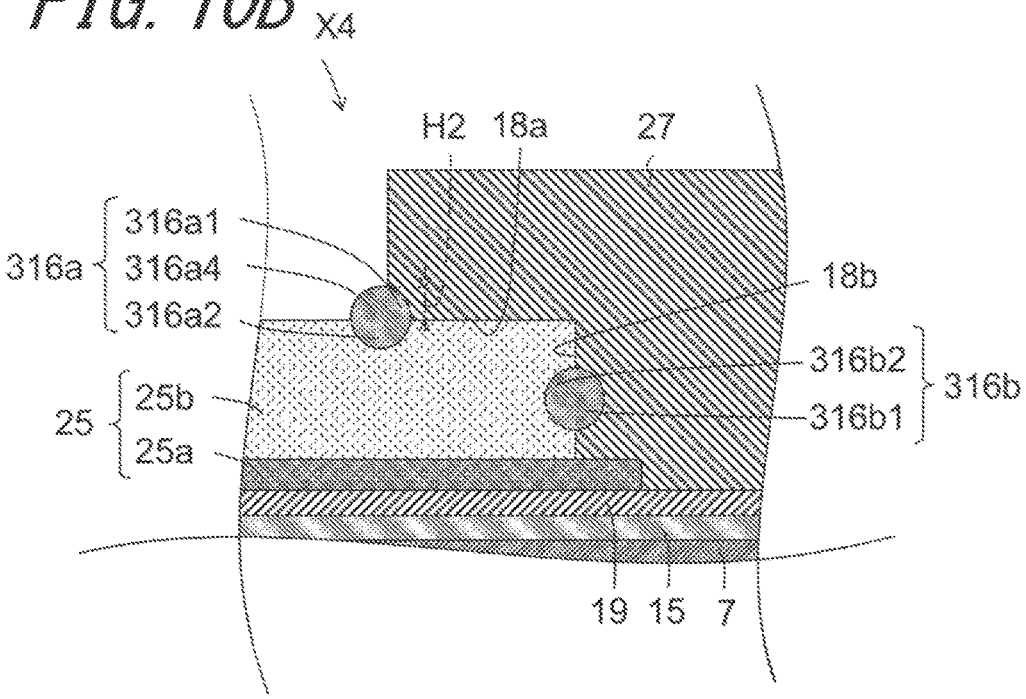

A thermal head X4 will be described with reference to FIGS. 10A and 10B. Reference sign H1 as shown in FIG. 10A represents a protruding height of an inorganic particle 316*c* from the conductive layer 25*b*. Moreover, reference sign H2 as shown in FIG. 10B represents a protruding height of an inorganic particle 316*a* from the conductive layer 25*b*. In addition, reference sign E1 as shown in FIG. 10A represents a first region, and reference sign E2 as shown in FIG. 10A represents a second region.

In the thermal head X4, inorganic particles 316 are different in structure from the inorganic particles 16 of the thermal head X1. The thermal head X4 has inorganic particles 316*a*, 316*b* and 316*c*. The inorganic particle 316*b* has a similar structure to that of the inorganic particle 16*b*, wherefore the description thereof will be omitted.

The inorganic particle 316*a* protrudes upward from the top surface 18*a* of the conductive layer 25*b*, and comprises a first portion 316*a*1, a second portion 316*a*2, and a fourth portion 316*a*4. The first portion 316*a*1 and the second portion 316*a*2 have a similar structure to those of the first portion 16*a*1 and the second portion 16*a*2, respectively, wherefore the descriptions thereof will be omitted.

The fourth portion 316*a*4 protrudes from the conductive layer 25*b* and the cover layer 27 and is exposed from the conductive layer 25*b* and the cover layer 27. Hence, when applying a yet-to-be-cured cover layer 27, the fourth portion 316*a*4 protruding from the conductive layer 25*b* can stem the flow of the yet-to-be-cured cover layer 27. This makes it possible to restrain the yet-to-be-cured cover layer 27 from spreading over a wide area, and thereby reduce a decrease in height of the cover layer 27. That is, the fourth portion 316*a*4 can block the flux of the cover layer 27.

The protective layer 25 has the first region E1 and the second region E2. The first region E1 is a region obtained by elongating a region where the heat generating section 9 is formed, in the main scanning direction. The second region E2 is a region other than the first region E1.

The first region E1 is provided with the inorganic particle 316*c*. The second region E2 is provided with the inorganic particle 316*a*. The height of the fourth portion 316*a*4 of the inorganic particle 316*a* from the conductive layer 25*b* in the second region E2 is greater than the height of a fourth portion 316*c*4 of the inorganic particle 316*c* from the conductive layer 25*b* in the first region E1.

This makes it possible to restrain the inorganic particle 316*c* against contact with the recording medium P (refer to FIG. 6) while blocking the flux of the cover layer 27 by the inorganic particle 316*a*. In consequence, reduction of the height of the cover layer 27 can be suppressed, and the recording medium P can be less prone to scratching.

For example, the thermal head X4 may be produced by the following procedure. As is the case with the thermal head X1, the protective layer 25 containing the inorganic particles 316 is prepared, and then the cover layer 27 is applied thereon and is cured. Next, the first region E1 of the protective layer 25 is subjected to surface polishing using a lapping film. This makes it possible to render the height of the inorganic particle 316*c* from the conductive layer 25*b* less than the height of the inorganic particle 316*a* from the conductive layer 25*b*.

While one embodiment according to the disclosure has been described heretofore, it should be understood that the invention is not limited to the above-described embodiment, and that various modifications and variations are possible without departing from the scope of the invention. For example, although the thermal printer Z1 employing the thermal head X1 implemented as the first embodiment has been shown herein, it is not intended to be limiting of the invention, and thus, the thermal heads X2 and X3 may be adopted for use in the thermal printer Z1. Moreover, the thermal heads X1 to X3 implemented as a plurality of embodiments may be used in combination.

For example, although the thin-film head having the thin heat generating section 9 obtained by forming the electrical resistance layer 15 in thin-film form has been described as exemplification, the invention is not limited to this. The invention may be embodied as a thick-film head having a thick heat generating section 9 by forming the electrical resistance layer 15 in thick-film form.

Moreover, although a flat-type head in which the heat generating section 9 is formed on the first surface 7*f* of the substrate 7 has been described as exemplification, the invention may be embodied as an edge-type head in which the heat generating section 9 is disposed on an end face of the substrate 7.

Moreover, the heat storage layer 13 may be provided with an underlayer portion which is located in other region than a region where the protuberance 13*a* is formed. The heat generating section 9 may be configured by forming the common electrode 17 and the discrete electrode 19 on the heat storage layer 13, and thereafter forming the electrical resistance layer 15 only in a region between the common electrode 17 and the discrete electrode 19.

The sealing member 12 and the hard coating 29 which covers the driving IC 11 may be formed of the same material. In this case, the hard coating 29 and the sealing member 12 may be concurrently formed by performing printing on a region where the sealing member 12 is to be formed when the hard coating 29 is printed.

REFERENCE SIGNS LIST

X1-X3: Thermal head
Z1: Thermal printer
E1: First region
E2: Second region
1: Heat dissipating plate
3: Head base body
7: Substrate
9: Heat generating section
13: Heat storage layer
14: Bonding member
16, 116, 216, 316: Inorganic particle
16*a*1, 16*b*1: First portion
16*a*2, 16*b*2: Second portion
216*b*3: Third portion
316*a*4, 316*b*4: Fourth portion
18*a*: Top surface
18*b*: Side surface
18*c*: Third interface
18*d*: Fourth interface
20: Interface
20*a*1, 20*b*1: First interface
20*a*2, 20*b*2: Second interface
22, 24, 30: Region
25: Protective layer
25*a*: Insulating layer
25*b*: Conductive layer
26: Second inorganic particle
27: Cover layer
31: Connector

The invention claimed is:

1. A thermal head, comprising:
a substrate;
a heat generating section disposed on the substrate;
an electrode disposed on the substrate electrically connected to the heat generating section;
a protective layer which covers the heat generating section and part of the electrode, the protective layer comprises an of inorganic material;
a cover layer disposed on the protective layer, the cover layer comprises a resin material; and
a first inorganic particle disposed on a surface of the protective layer protruding from the surface,
the first inorganic particle comprising
a first portion located inside the cover layer and
a second portion located inside the protective layer.

2. The thermal head according to claim 1,
wherein the first inorganic particles comprises
a first interface which defines a boundary face between the first portion and the cover layer, and
a second interface which defines a boundary face between the second portion and the protective layer, and
the first interface is greater in length than the second interface, as seen in sectional view.

3. The thermal head according to claim 1,
wherein the first portion comprises a part of the first inorganic particle which has a maximum diameter of the first inorganic particle, as seen in sectional view.

4. The thermal head according to claim 1, further comprising:
a third interface which defines a boundary face between the protective layer and the cover layer,
wherein the first portion comprises a projection protruding in a direction away from the third interface.

5. The thermal head according to claim 1,
wherein the protective layer comprises
an insulating layer located on the heat generating section and the electrode, and
a conductive layer located on the insulating layer, and
the insulating layer is greater in width than the conductive layer, as seen in sectional view.

6. The thermal head according to claim 5,
wherein a top surface and a side surface of the conductive layer is covered with the cover layer,
the first inorganic particle is disposed on the side surface of the conductive layer protrudes from the side surface, and
a resin material constituting the cover layer enters a region between the first portion of the first inorganic particle and the insulating layer.

7. The thermal head according to claim 5,
wherein the second portion of each of the first inorganic particles comprises a third portion located inside the insulating layer.

8. The thermal head according to claim 1, further comprising a second inorganic particle which are smaller in average particle size than the first inorganic particle, wherein the second inorganic particle are located in the protective layer.

9. The thermal head according to claim 1, wherein the first inorganic particle has a fourth portion exposed from the protective layer and the cover layer.

10. The thermal head according to claim 9, wherein the protective layer has a first region located above the heat generating section and a second region other than the first region, and a height of the fourth portion of the first inorganic particle from the protective layer in the second region is greater than a height of the fourth portion of the first inorganic particle from the protective layer in the first region.

11. A thermal printer, comprising:

the thermal head according to claim 1;

a conveyance mechanism which conveys a recording medium onto the heat generating section; and a platen roller which presses the recording medium against a top of the heat generating section.

* * * * *